US005815954A

United States Patent [19]

Huang

[11] Patent Number: 5,815,954

[45] Date of Patent: Oct. 6, 1998

[54] SHOE WITH AN ELECTRONIC STEP COUNTER

[76] Inventor: Tien-Tsai Huang, No. 4-2, Lane 30, Wu Chuan St., Pan Chiao City, Taipei, Taiwan

[21] Appl. No.: 855,597

[22] Filed: May 13, 1997

[51] Int. Cl.[6] ..... A43B 5/00; A43B 13/20

[52] U.S. Cl. ..... 36/132; 36/29; 73/172

[58] Field of Search ..... 36/132, 136, 1, 36/29; 128/779; 73/172, 714

[56] References Cited

U.S. PATENT DOCUMENTS

| | | |
|---|---|---|
| 2,558,805 | 7/1951 | Yaglou . |
| 4,402,147 | 9/1983 | Wu . |
| 4,510,704 | 4/1985 | Johnson . |
| 5,230,249 | 7/1993 | Sasaki et al. . |
| 5,655,316 | 8/1997 | Huang . |
| 5,661,916 | 9/1997 | Huang . |

*Primary Examiner*—Ted Kavanaugh

*Attorney, Agent, or Firm*—Bacon & Thomas

[57] ABSTRACT

A shoe with an electronic step counter including a shoe body, a fluid bladder, a pressure sensor, a temperature compensator, a transmitting circuit, and a receiving circuit. The shoe body has a vamp and an outsole having a receiving space for receiving the fluid bladder. The pressure sensor contacts the fluid in the fluid bladder to detect the pressure thereof and generating a pressure voltage signal. The temperature compensator communicates with the fluid in the fluid bladder, detects the temperature thereof, and generating a temperature voltage signal. The transmitting circuit is disposed in the receiving space of the outsole and connected to the pressure sensor and the temperature compensator. The transmitting circuit receives the pressure voltage signals and the temperature voltage signals, convert them into a value which is emitted in a radio signal. The receiving circuit is disposed separate from the transmitting circuit and may receive the radio signal from therefrom. The receiving circuit demodulates and decodes the received radio signal and display the thus obtained value.

12 Claims, 6 Drawing Sheets

SHOE WITH AN ELECTRONIC STEP COUNTER

BACKGROUND OF THE INVENTION (a) Field of the Invention

The present invention relates generally to a shoe with a step counter, and more particularly to a shoe with an electronic step counter, having a transmitting circuit and a receiving circuit for measuring the weight of the wearer and the number of steps taken, and estimating the calorie consumed.

(b) Description of the Prior Art

Ordinary weighing machines are not portable and cannot be carried around. Conventional step counters are portable, but one may forget to bring along the step counter when going out for exercise.

Over-weight indicates that excessive fat has accumulated in the body. Physicians have advised that over-weight people should consume a certain amount of calorie. According to medical reports, walking at speed of 4 km per hour may use up about 2.0 calories per kg.

Walking at a faster rate of 6.4 km per hour may use up about 3.4 calories per kg. Walking at still a faster speed of 8.5 km per hour may use up about 9.3 calories per kg. To allow people to know the number of steps taken or the rate of walking, step counters are provided.

Conventional step counters are designed to hang round the user's body, which is not convenient to the user. Besides, even the user walks too steadily that there is little vibration, the step counter may not be actuated. It is therefore desirable to have shoe with an electronic counter which, aside from counting the steps taken, may selectively display the weight of the user and the value of calorie consumed.

SUMMARY OF THE INVENTION

A primary object of the present invention is to provide a shoe with an electric step counter having a transmitting circuit and a receiving circuit, for measuring the weight of the user, counting the steps taken, and estimating the value of calorie consumed.

Another object of the present invention is to provide a shoe with an electric step counter having a transmitting circuit and a receiving circuit, in which the receiving circuit is separately disposed from the transmitting circuit for receiving signals emitted by the transmitting circuit to facilitate reading of the displayed values.

The shoe having an electronic step counter according to the present invention essentially comprises a shoe body, a fluid bladder, a pressure sensor, a temperature compensator, a transmitting circuit, and a receiving circuit.

The shoe body according to the present invention may be an ordinary shoe for children, adults, or leather shoes, sports shoes, and the like. Each shoe has a vamp and an outsole. The outsole has a receiving space. The electronic step counter may be disposed in one of a pair of shoes or certainly, a pair of shoes.

The fluid bladder is disposed in the receiving space of the outsole and is filled with a fluid such as a gas (e.g., air or nitrogen), a liquid (e.g., water or oil), or silicon rubber. The receiving space may be provided with suitable reinforcing ribs or partitions to reinforce the structural strength of the outsole, match the position of the fluid bladder, and positioning the fluid bladder in place. The fluid bladder is filled with a gas or liquid and may have any suitable shape. The fluid bladder may be divided into a plurality of fluid chambers, each of which communicates with each other.

The pressure sensor may contact the flowing fluid in the fluid bladder to detect the pressure of the fluid and thereby generate a pressure voltage signal.

The temperature compensator may be disposed in the fluid bladder and in communication with the fluid. It may also be disposed at one side of the pressure sensor or juxtaposed therewith for detecting the temperature of the fluid and thereby generating a pressure voltage signal. The fluid in the bladder may expand or contract due to change in ambient temperature, so that the fixed volume of the fluid changes. Consequently, the detected temperature value may not be accurate. The temperature compensator is therefore provide to correct the temperature value. Preferably, a fluid that is less influenced by ambient temperature is selected.

The transmitting circuit is disposed in the receiving space of the outsole and is electrically connected to the pressure sensor and temperature compensator. The pressure voltage signal and the temperature voltage signal transmitted therefrom were amplified by the transmitting circuit and converted into a frequency signal which is computed into a value which is emitted in the form of a radio signal.

The receiving circuit is disposed separate from the transmitting circuit. It receives the radio signal from the transmitting circuit and demodulates, amplifies, and display the value. The receiving circuit may be disposed on a wrist watch or a necklace to facilitate carrying.

Due to the cooperation of the pressure sensor and the temperature compensator, the value of pressure borne by the shoe body and the number of times of pressure exertion may be obtained to arrive at an estimate of calorie consumption. The value is transmitted by the transmitting circuit and received by the receiving circuit for display. Therefore, the shoe with an electric step counter according to the present invention may, aside from counting the steps, measure the weight of the user, and provide an estimate of the calorie consumed.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
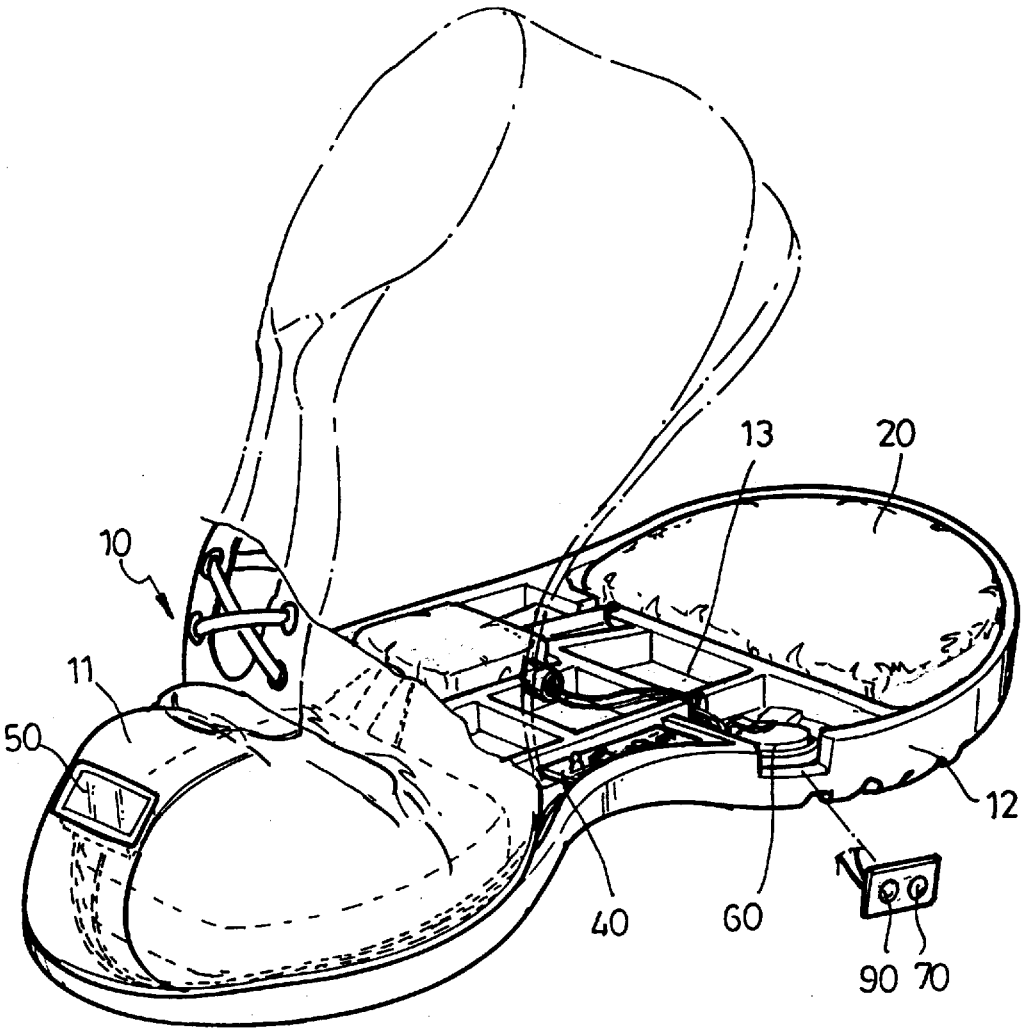
FIG. 1 is a schematic exploded view of a first preferred embodiment of the present invention.

Referring to FIG. 1, the shoe with an electronic step counter according to the present invention essentially comprises a shoe body 10, a fluid bladder 20, a pressure sensor 45 (not shown in FIG. 1), a temperature compensator 50 (not shown in FIG. 1), a transmitting circuit 40, and a receiving circuit 70 (not shown in FIG. 1).

The shoe body 10 has a vamp 11 and an outsole 12. The fluid bladder 20, pressure sensor 45, temperature compensator 50, and transmitting circuit 40 are all disposed in a receiving space 13 in the outsole 12.

Figure 3:
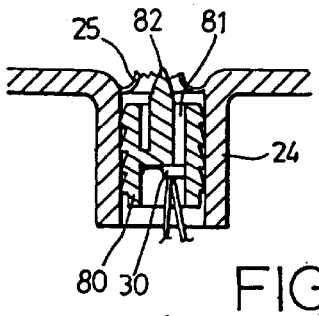
FIG. 3 is a schematic assembled view of the first preferred embodiment of the present invention.
Figure 2:
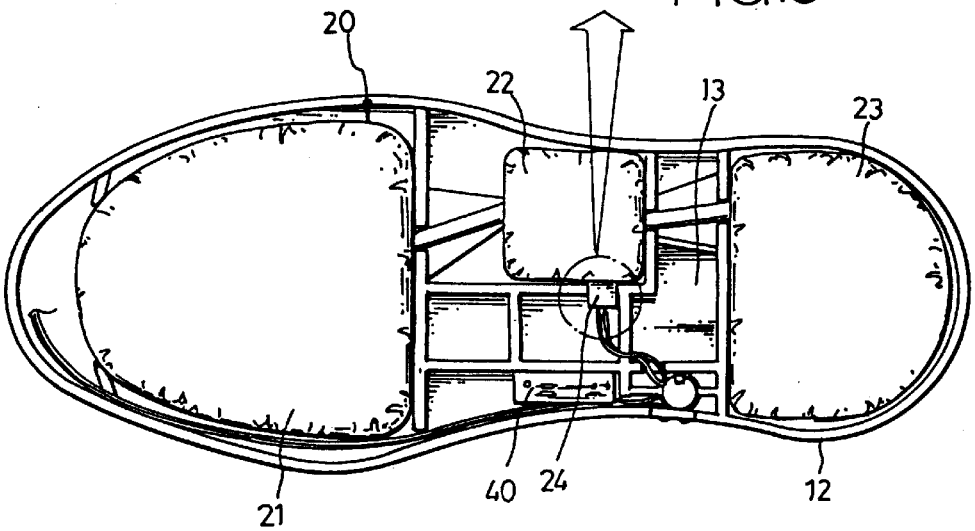
FIG. 2 is a schematic sectional view of a connector fitted to an outlet of a fluid bladder according to the first preferred embodiment of the present invention.

Referring to FIGS. 2 and 3, which show a first preferred embodiment, the fluid bladder 20 includes a front fluid chamber 21, an intermediate fluid chamber 22, and a rear fluid chamber 23, each chamber communicating with each other. The fluid bladder 20 has an outlet 24 located at the intermediate fluid chamber 22, the outlet having a diaphragm 25.

In the first preferred embodiment, the pressure sensor 45 and the temperature compensator are coupled to a connector 30, which has a through hole 31 and a projecting spike 32. Since the connector 30 is closely fitted to the fluid bladder 20, when the connector 30 is fitted to the outlet 24 of the fluid bladder 20, the projecting spike 32 of the connector 30 may pierce the diaphragm 25 of the outlet 24, so that fluid 26 inside the fluid chamber 20 may flow via the through hole 31 of the connector 30 and come into contact with the pressure sensor 45 and the temperature sensor 50.

Since the fluid bladder 20 is disposed in the receiving space 13 in the outsole 12, when the user puts on the shoes of the present invention, his/her body weight fall on the fluid bladder 20 in each shoe, so that the associated pressure sensor 45 will sense the state of the fluid bladder 20 being pressured and obtain a pressure voltage signal. At the same time, the temperature compensator 50 will also detect the temperature of the fluid inside the fluid bladder 20 and further obtain a temperature voltage signal.

Figure 6:
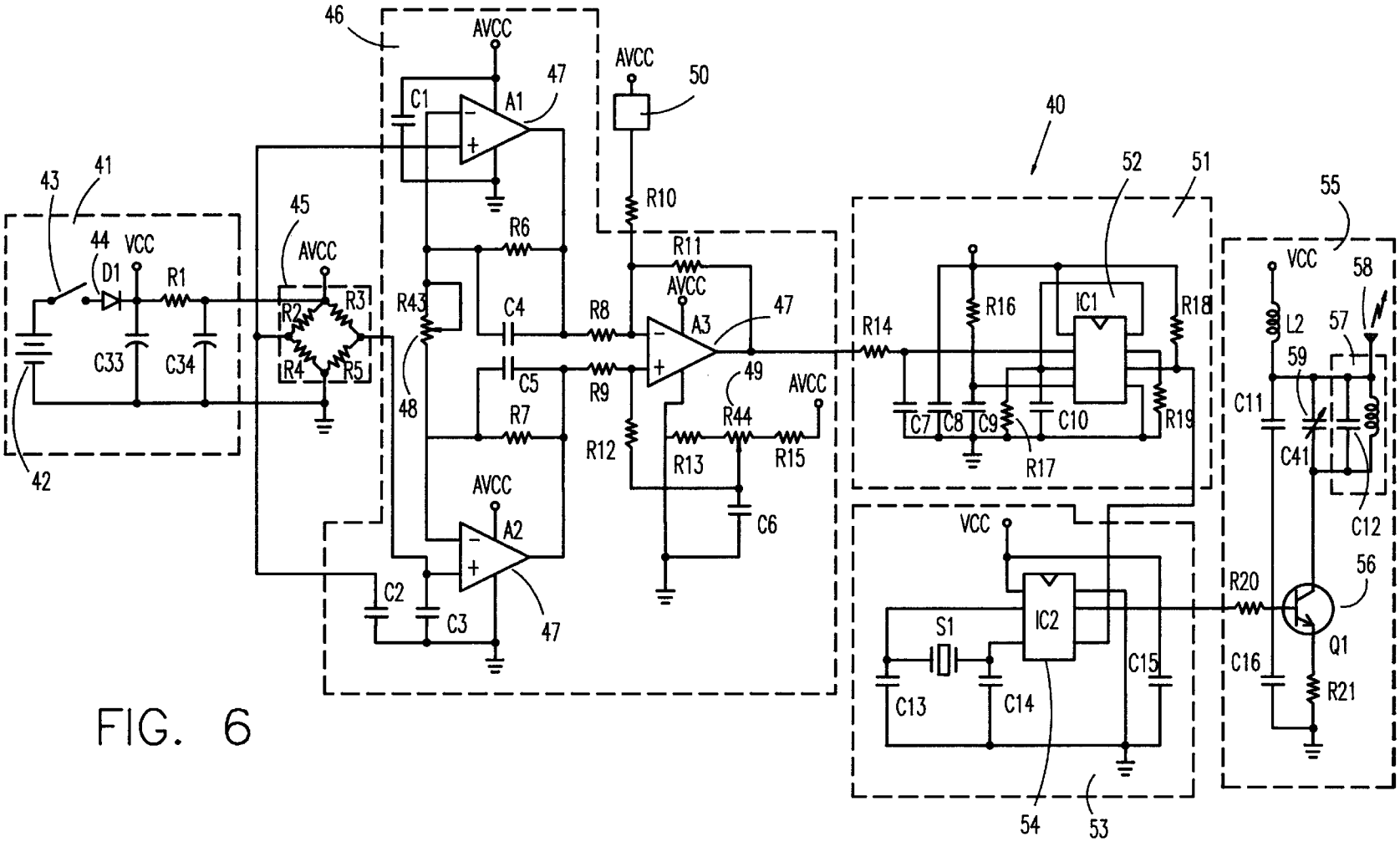
FIG. 6 is a circuit diagram of a transmitting circuit of the present invention.

Referring to FIG. 6, the transmitting circuit 40 of the present invention includes a first electric source circuit 41, a first amplifying circuit 46, a converting circuit 51, a first micro-control circuit 53, and a radio transmitting circuit 55.

In the first preferred embodiment of the present invention, the first electric source circuit 41 includes two first battery cells 42, a first switch 43, and a protective element 44. The first batteries are comprised of two dc battery cells of 1.5 connected in series (may be replaced by mercury battery cells or lithium cells), for providing the transmitting circuit 40 with the required electric power. The first switch 43 controls the on's and off's of the first electric source circuit 41 for saving electric power when not in use. the protective element 44 is a geranium diode D1, which may prevent circuit damage if the first battery cells 42 are installed in the wrong orientation.

The first amplifying circuit 46 in the first preferred embodiment is comprised of three amplifiers 47, a multiplier element 48, and a reset element 49. The pressure sensor 45 and the temperature compensator 50 are electrically connected to the first amplifying circuit 46. The amplifiers 47 are OP operational amplifiers of the model TL074N, which may amplify the pressure voltage signals and temperature voltage signals (by 250 times) respectively from the pressure sensor 45 and the temperature compensator 50 and then transmit the same to the converting circuit 51. The number of times of voltage amplification is controlled by the multiplier element 48. In addition, in order that the pressure voltage signal may return to zero when the user lifts his foot (hence the shoe), the reset element 49 is provided in the first preferred embodiment.

The converting circuit 51 includes at least one converter device 52. The converting circuit 51 receives the amplified pressure voltage signals and amplified temperature voltage signals from the first amplifying circuit 46 and converting the same into frequency signals, which are then transmitted to the first micro-control circuit 53. The converter 52 in the first preferred embodiment is a V-F converter of the model XR-4151.

The first micro-control circuit 53 includes a first micro-controller 54. The micro-control circuit 53 processes the frequency signals received to obtain a value, which includes a pressure value obtained by the pressure sensor 45 in conjunction with the temperature compensator 50, number of times that the sensor is pressured, and a rough estimate of the calories consumed. The value is then transmitted to the radio transmitting circuit 55. The first micro-controller 54 adopted in the first preferred embodiment is model PIC12C508.

Sources of obtaining the above-mentioned pressure value, number of times the sensor is pressured, and the estimate of calorie consumption are described below:

1. Pressure value: The pressure sensor 45 generates a pressure voltage signal, which is processed and computed by the micro-controller 54 to arrive at a value, so that the weight of the user may be obtained. When power supply to the transmitting circuit 40 is stopped, the pressure value will reset.
2. Number of times pressure is detected: A standard value is set in the micro-controller 54. When the pressure sensor 45 detects a pressure voltage signal smaller than the standard value, it indicates that the user has lift the shoe off the ground. When the pressure sensor 45 detects a pressure voltage signal exceeding the standard value, it indicates that the user presses the shoe against ground. The micro-controller 45 will count the number of cycles, i.e., lifting and setting the shoe off and on the ground, to obtain a total number of times and hence the number of steps.
3. Calorie consumption value: it is the product of the pressure value and the number of times the sensor is pressured. The product is then multiplied by a constant to obtain the number of calorie consumed.

The radio transmitting circuit 55 includes a modulator 56, a first resonance circuit 57, an emitting antenna 58, and a frequency modulating element 59. The modulator 56 modulates the value transmitted thereto an AM frequency, which is emitted in the form of high-frequency radio signal of low power by the first resonance circuit 57 of a high-frequency LC via the emitting antenna 58. A variable capacitor C41 may be adopted as the frequency modulating element 59 for modulating the radio emitting frequency in the first preferred embodiment.

Figure 7:
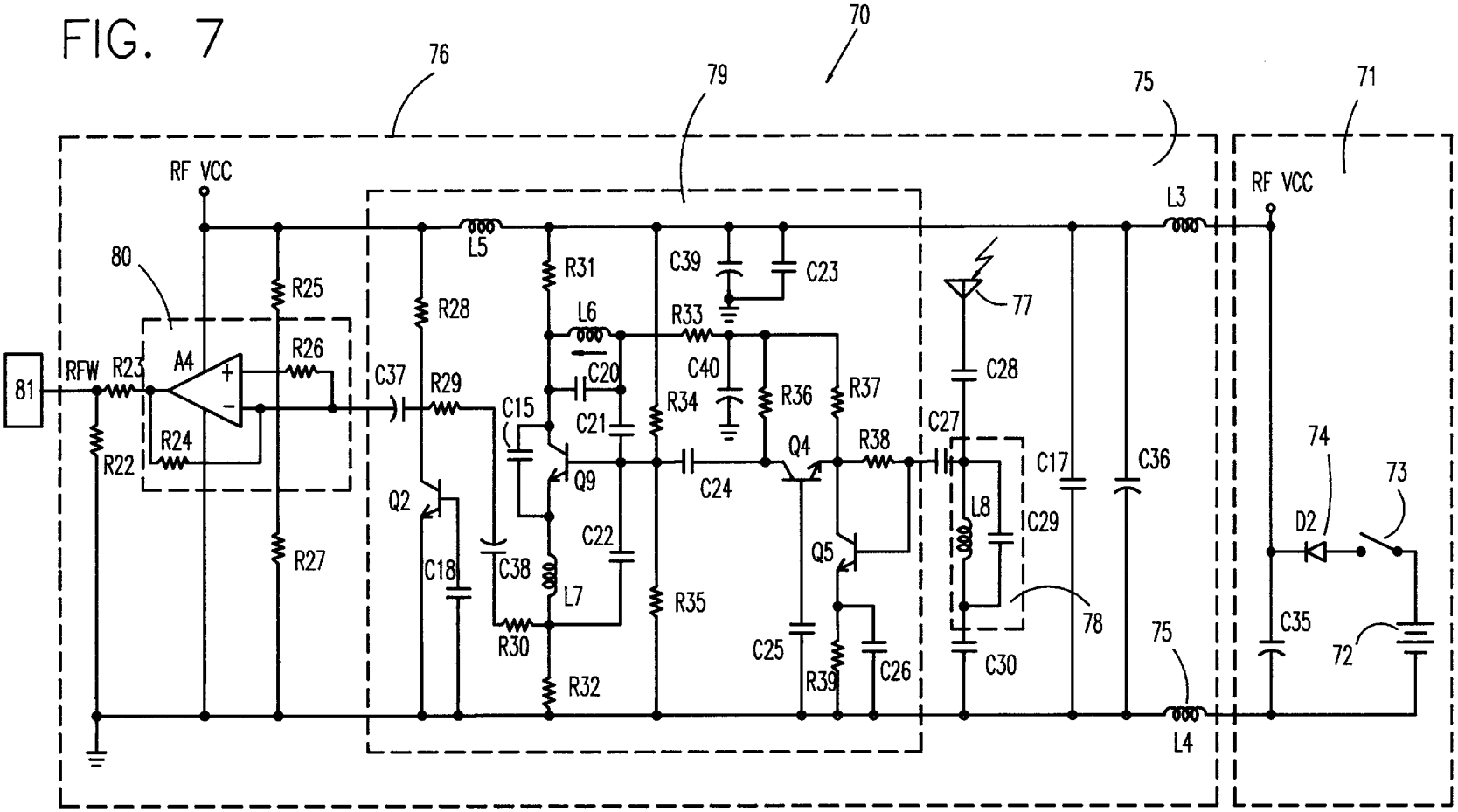
FIG. 7 is a circuit diagram of the receiving circuit of the present invention.
Figure 8:
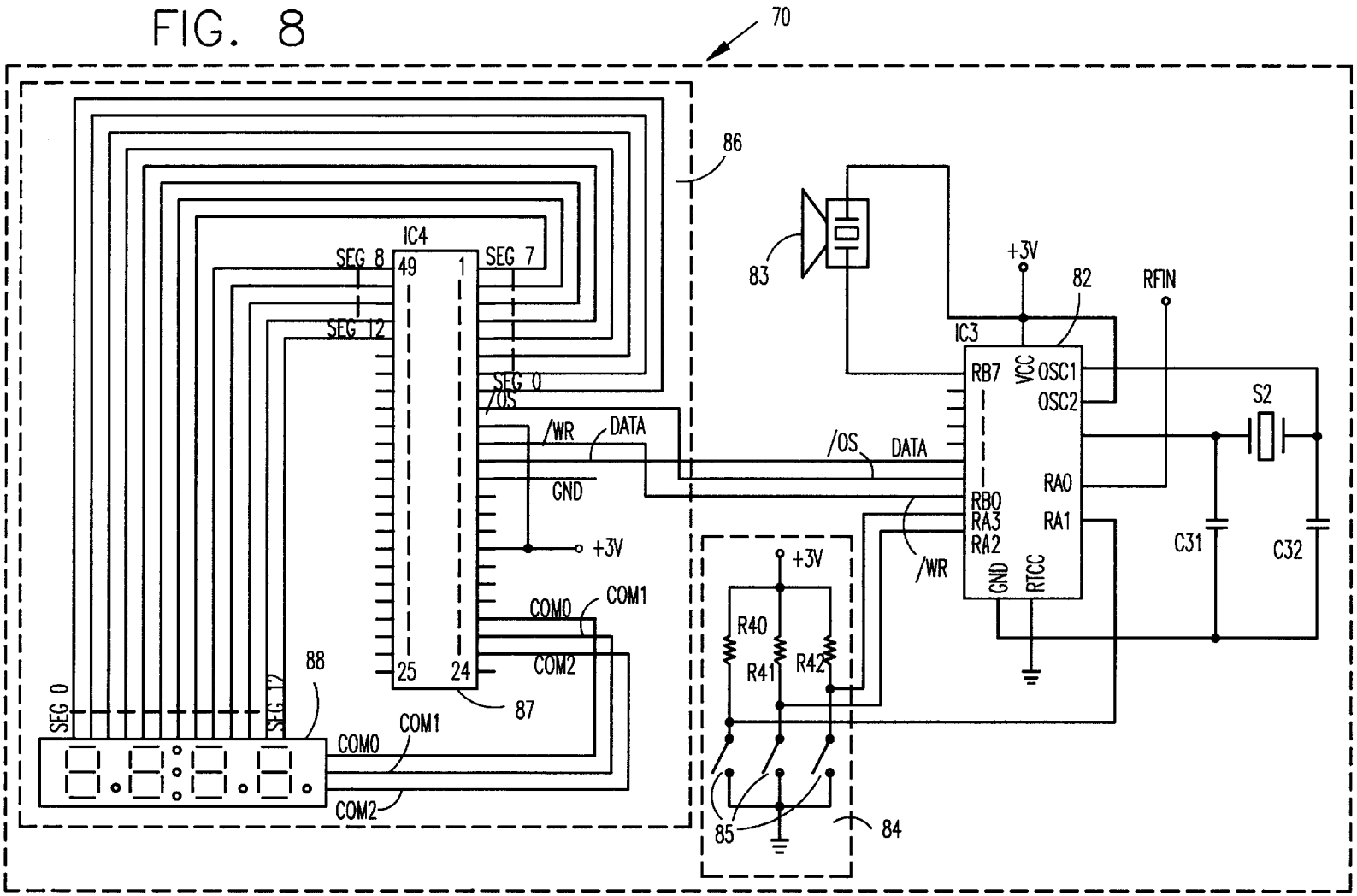
FIG. 8 is a circuit diagram of a reception control circuit of the receiving circuit of the present invention.

Referring to FIGS. 7 and 8, the receiving circuit 70 in the first preferred embodiment includes a second electric source circuit 71, a signal receiving circuit 76, a second amplifying circuit 79, a signal pick-up circuit 80, and a reception control circuit 81.

The second electric source circuit 71 includes two second battery cells 72, a second switch 73, a protective element 74, and a plurality of noise filtering elements 75. The second battery cells 72 are two dc battery cells of 1.5 volt connected in series (may be replaced by mercury cells or lithium cells), for providing the electric power required by the receiving circuit 70. The second switch 73 controls the on's and off's of the second electric source circuit 71 for saving power when not in use. The protective element 74 is a geranium diode D2 for prevent circuit damage resulting from wrong installation of the battery cells 72.

The signal receiving circuit 76 may receive radio signals emitted from the transmitting circuit 40. The signal receiving circuit 76 includes a noise filtering element 75, a receiving antenna 77, and a second resonance circuit 78. The receiving antenna 77 receives radio signals and pass the same to the second resonance circuit 78. The latter is a modulator constituted by an LC resonance, for filtering the frequency of the radio signals emitted by the transmitting circuit 40 and transmitting the filtered signals to the second amplifying circuit 79. In order to filter the received filtered signals and to prevent interference, the noise filtering element 75 in the first preferred embodiment is a pair of inductors L3, L4.

The second amplifying circuit 79 is essentially a high-frequency series amplifying circuit comprised of transistors Q2, Q3, and Q4, for amplifying the filtered radio signals received thereby and transmitting the amplified signals to the signal pick-up circuit 80 to obtain a voltage change generated when a radio signal has been received or no radio signal has been received. And the voltage change signal is transmitted to the reception control circuit 81.

The reception control circuit 81 includes a second micro-controller 82, a function control circuit 84, and a liquid crystal display circuit 86. The second micro-controller 82 may decode the signal from the signal pick-up circuit 80 to obtain the value emitted by the transmitting circuit 40. After obtaining the value, the user may select the required data by controlling the function control circuit 84. In the first preferred embodiment, the function control circuit has three control buttons 85, which may be set to respectively output three output signals, namely the pressure value, the number of times the sensor is pressured, and the calorie consumption value from the transmitting circuit 40,. These values (i.e., the three output signals) are indicated by the LCD circuit 86. The LCD circuit 86 includes a liquid crystal display driver 87 and a liquid crystal display 88. The LCD driver 87 receives the specified output signals and drives the the LCD 88 to display the required data. The second micro-controller 82 in the first preferred embodiment is an IC of the model PIC16C54.

Figure 5:
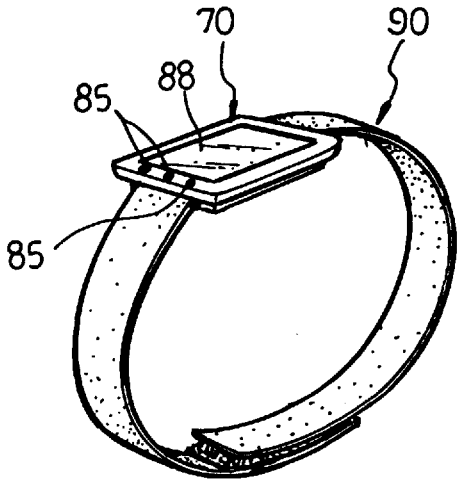
FIG. 5 is a schematic outer view of a receiving circuit of the present invention on a wrist watch.

In order to facilitate tea users to read the values received by the receiving circuit 70 at near distance any time, the receiving circuit 70 is disposed on a watch 90 in the first preferred embodiment, as shown in FIG. 5.

In addition, the reception control circuit 81 in the first preferred embodiment further includes a buzzer 83, which is a capacitor type piezo electric buzzer electrically connected to the second micro-controller 82. The use may present a predetermined value, such as the number of times of pressure exertion or the value of calorie consumption, using the second micro-controller 82. When the value received by the second micro-controller 82 from the transmitting circuit 40 is equal to or higher than the predetermined value, the buzzer will sound to inform the user.

Figure 4:
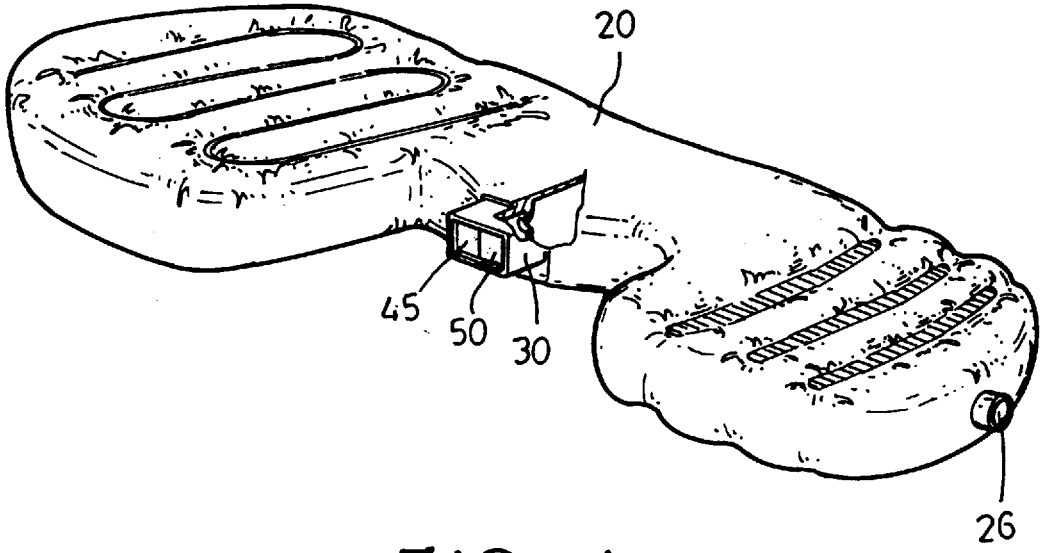
FIG. 4 is a schematic view showing the coupling of a fluid bladder and a connector according to according to a second preferred embodiment of the present invention.

FIG. 4 shows a second preferred embodiment. The structure and operation of the second preferred embodiment is the same as those of the first preferred embodiment, except that the fluid bladder 20 has a connector 30, and the pressure sensor 45 and th temperature compensator 50 are coupled to the connector 30 by fusion or bonding. In other words, the fluid bladder and the connector 30 are integrally made and are shaped to match the shape of the outsole; the pressure sensor 45 and the temperature compensator 50 are tightly coupled to the connector 30. In order to facilitate detection of fluid pressure and temperature, the top ends of the pressure sensor 45 and the temperature compensator 50 are exposed in the fluid bladder 20 so that they may contact the fluid. Furthermore, the connector, the outer rim of the pressure sensor 45, and the outer rim of the temperature compensator 50 are of the same material, so that they may be fused together or bonded together. In this way, the detecting portions at the respective top ends of the pressure sensor 45 and the temperature compensator 50 are all located at the inner side of the fluid bladder 20. Fluid is poured into the fluid bladder via a nozzle 26 thereof, and the nozzle 26 is subsequently sealed to prevent fluid leakage.

When people go out or exercise, they must wear shoes. The shoe with step counter according to the present invention enables people to count their steps, measure their weight and know the calories consumed any time without using any special tools. Besides, the measured values may be shown by a receiving circuit disposed on a watch, bracelet, bangle, necklace, and the like so that users may read the values conveniently.

Although the present invention has been illustrated and described with reference to the preferred embodiment thereof, it should be understood that it is in no way limited to the details of such embodiment but is capable of numerous modifications within the scope of the appended claims.

What is claimed is:

1. A shoe with an electronic step counter, comprising:

a shoe body, said shoe body having a vamp and an outsole, said outsole having a receiving space;

a fluid bladder, disposed in said receiving space of said outsole, and being filled with a fluid;

a pressure sensor, communicating with said fluid for detecting the pressure of said fluid and generating a pressure voltage signal;

a temperature compensator, that may be communicate with said fluid, for detecting the temperature of said fluid and generating a temperature voltage signal;

a transmitting circuit, disposed in said receiving space of said outsole, and including a first electric source circuit, a first amplifying circuit, a converting circuit, a first micro-control circuit, and a radio transmitting circuit, said first electric source circuit supplying said transmitting circuit with the necessary electric power; said first amplifying circuit being electrically connected to said pressure sensor and said temperature compensator, and transmitting said pressure voltage signal and said temperature voltage signal to said converting circuit, said converting circuit converting said signals into a frequency signal and transmitting the same to said micro-control circuit, said micro-control circuit computing said frequency signal to obtain a value, which is modulated by said radio transmitting circuit before being emitted; and a receiving circuit, disposed apart from said transmitting circuit, and including a second electric source circuit, a signal receiving circuit, a second amplifying circuit, a signal pick-up circuit, and a reception control circuit; said second electric source circuit supplying said receiving circuit with the necessary electric power; said signal receiving circuit receiving said radio signal emitted by said transmitting circuit and demodulating said radio signal received before transmitting the same to said second amplifying circuit for amplification, the amplified signal being transmitted via said signal pick-up circuit to said reception control circuit for decoding, controlling, and displaying the value transmitted from said transmitting circuit.

2. A shoe with an electronic step counter as claimed in claim 1, wherein said first electric source circuit and said second electric source circuit are respectively provided with a first switch and a second switch.

3. A shoe with an electronic step counter as claimed in claim 1, wherein said first electric source circuit and said second electric source circuit are respectively provided with a protective element, which is a geranium diode.

4. A shoe with an electronic step counter as claimed in claim 1, wherein said first amplifying circuit includes a plurality of amplifiers, a multiplier element, and a reset element.

5. A shoe with an electronic step counter as claimed in claim 1, wherein said converting circuit includes at least one converter, and said micro-control circuit includes at least one fist micro-controller.

6. A shoe with an electronic step counter as claimed in claim 1, wherein said radio transmitting circuit includes a modulator, a first resonance circuit, an emitting antenna, and a frequency modulating element.

7. A shoe with an electronic step counter as claimed in claim 1, wherein said signal receiving circuit includes a plurality of noise filtering elements, a receiving antenna, a second resonance circuit, a second amplifying circuit, and a signal pick-up circuit.

8. A shoe with an electronic step counter as claimed in claim 1, wherein said reception control circuit includes a second micro-control circuit, a buzzer, a function control circuit, and a liquid crystal display circuit, said liquid display circuit including a liquid display driver and a liquid crystal display.

9. A shoe with an electronic step counter as claimed in claim 8, wherein said liquid display circuit has a plurality of display modes, said display modes changing in accordance with the state of said function control circuit.

10. A shoe with an electronic step counter as claimed in claim 8, wherein said liquid crystal display circuit has a display mode which is a pressure value display mode, said pressure value displayed by said liquid crystal display and being a value computed by said first micro-controller which receives a pressure voltage signal generated by said pressure sensor.

11. A shoe with an electronic step counter as claimed in claim 8, wherein said liquid crystal display circuit has a display mode which is a mode displaying the number of times of pressure exertion, the rising and lowering of values computed by said first micro-controller being counted as one time of pressure exertion, and the total number of times being shown by said liquid crystal display.

12. A shoe with an electronic step counter as claimed in claim 8, wherein said liquid crystal display circuit has a display mode which is a calorie consumption value display mode, said calorie consumption value being obtained by the multiplication of a product of a pressure value and the number of times of pressure exertion by a constant, said calorie consumption value being displayed by said liquid crystal display.

* * * * *